United States Patent [19]

Kuokkanen

[11] Patent Number: 5,028,896

[45] **Date of Patent: * Jul. 2, 1991**

[54] STRIPLINE CIRCUIT

[75] Inventor: Lauri Kuokkanen, Oulu, Finland

[73] Assignee: Solitra OY, Kempele, Finland

[ * ] Notice: The portion of the term of this patent subsequent to Mar. 27, 2007 has been disclaimed.

[21] Appl. No.: 477,254

[22] Filed: Feb. 7, 1990

Related U.S. Application Data

[63] Continuation-in-part of Ser. No. 275,350, Nov. 22, 1988, Pat. No. 4,912,437.

[30] Foreign Application Priority Data

Nov. 23, 1987 [FI] Finland ..... 875160
Sep. 6, 1989 [FI] Finland ..... 894207

[51] Int. Cl.[5] ..... H01P 1/00

[52] U.S. Cl. ..... 333/246; 333/224; 333/263

[58] Field of Search ..... 333/205, 224, 226, 235, 333/238, 246, 263; 361/399

[56] References Cited

U.S. PATENT DOCUMENTS

| | | | |
|---|---|---|---|
| 4,268,809 | 5/1981 | Makimoto et al. | 333/224 X |
| 4,281,302 | 7/1981 | Stegens | 333/205 X |
| 4,477,788 | 10/1984 | Collinet et al. | 333/205 X |
| 4,912,437 | 3/1990 | Kuokkanen | 333/224 |

*Primary Examiner*—Paul Gensler
*Attorney, Agent, or Firm*—Ladas & Parry

[57] ABSTRACT

The invention relates to a stripline circuit comprising at least one stripline pattern (2 to 6) made of a material of high electrical conductivity on the surface of a printed board (1) made of a dielectric material, a metallic or metal coated cover (8 to 12) being provided in the vicinity of the stripline pattern in an electrically non-conducting manner with respect to it, and the distance of the cover (8 to 12) from the stripline pattern being adjustable to regulate the characteristic impedance of the stripline. In order to simplify practical circuit solutions, each cover (8 to 12) is integral with a casing (7) protecting the printed board (1).

8 Claims, 1 Drawing Sheet

STRIPLINE CIRCUIT

This is a continuation-in-part of copending application Ser. No. 07/275,350 filed on Nov. 22, 1988, now issued as U.S. Pat. No. 4,912,437 on Mar. 27, 1990.

The invention relates to a stripline circuit comprising at least one stripline pattern made of a material of high electrical conductivity on the surface of a printed board made of a dielectric material, a metallic or metal-coated cover being provided in the vicinity of the stripline pattern in an electrically non-conducting manner with respect to it, and the distance of the cover from the stripline pattern being adjustable to regulate the characteristic impedance of the stripline.

In high-frequency circuit implementations, savings are attained in costs and space by using stripline technology. Besides actual microwave applications, significant advantage may also be gained in metric and decimetric wave (VHF, UHF) circuit implementations. Along with the surface mounting technique, these devices have become and are ever becoming smaller in size.

Inductances are needed in many cases to implement high-frequency circuits. Often the inductance is small, but particularly in tuned circuits and filters the value must be very accurate. The cost for the capacitors needed in the circuits will increase, and they are more poorly accessible on account of the higher requirements on tolerances. Furthermore, the parameters of semiconductors vary owing to variations in production quality and may influence the frequency of resonance circuits. This condition is remedied by using either an adjustable capacitor or a coil having an adjustable inductance in the circuit. In comparison with fixed capacitors, adjustable capacitors are large in size and either unreliable with age or expensive. Adjustable inductances are also large in size and expensive.

For easy and inexpensive compensation for variation in capacitor tolerances and other circuit parameters as well as variation in the manufacturing tolerances of the transmission line, Finnish Published Specification 78580 teaches that the adjustment of stripline characteristics is carried out by regulating the characteristic impedance of the stripline by disposing a metallic or metal-coated cover in an electrically non-conducting manner in the vicinity of the stripline pattern, the distance of the cover from the stripline pattern being adjusted.

One and the same printed board body, however, typically has several stripline patterns, each one of which has to be covered with a separate cover, according to the principle disclosed in Finnish Published Specification 78580. In addition, it is in many cases necessary to protect the high-frequency circuit on the printed board separately, so that the mechanical circuit structure becomes unreasonably complicated. The object of the present invention is to simplify the mechanical structure of a circuit solution realized according to the principle disclosed in the above-mentioned Finnish Published Specification. By means of the stripline circuit of the type described at the beginning, this is achieved in such a manner that each cover is integral with a casing protecting the whole printed board.

The basic idea of the invention is that the printed board body is in each case protected with a casing, the adjustable covers being integral with the casing.

In the circuit realized according to the invention it is thereby not necessary to install each cover separately on the printed board, because the covers are integral with the casing protecting the printed board body. Instead, the casing is simply fitted in place on the printed board body. On the other hand, it is to be noted that the use of the structure of the invention ensures that the high-frequency circuit used in each particular case will be protected sufficiently.

According to the preferred embodiment of the invention, each cover is formed by an area defined by a cover pattern perforated in the casing. In this way a movable cover structure can be joined to the otherwise fixed casing.

In the following the invention will be described in greater detail with reference to the figures of the attached drawing, wherein FIG. 1 is a perspective view of a structure according to the invention when the casing and the printed board are apart from each other;

Figure 1:
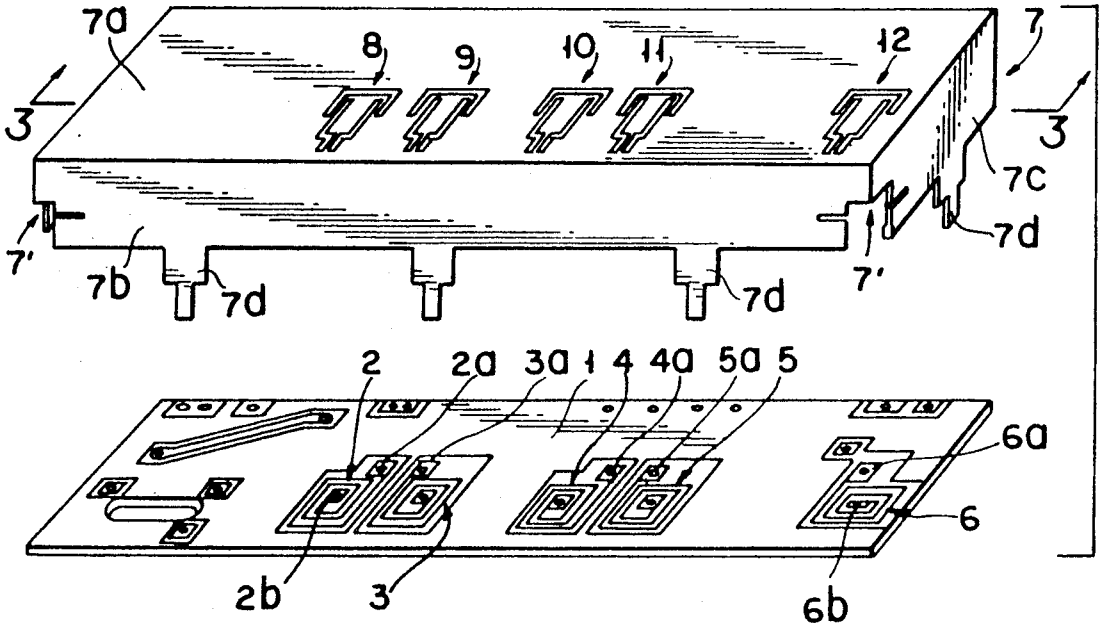

In the structure of FIG. 1, a stripline circuit has been formed on the surface of a printed board body. The stripline circuit comprises several separate stripline patterns 2 to 6. In this case, the stripline patterns are identical with each other but they can as well be different from each other. The shape of the patterns depends fully on the designed purpose, so their shape may vary greatly in practice. In this particular case, each pattern is in the form of an angular spiral formed by straight transmission line portions. The spiral begins from a square plate 2*a* to 6*a* on the outer edge of the pattern and terminates in a square plate 2*b* to 6*b* in the middle of the pattern.

The circuit board body 1 is formed in a manner known per se by a dielectric board which may be made of Teflon insulated fibre glass laminate, for instance. The material of the dielectric board, however, is not of any essential importance in view of the inventive idea.

The entire printed board body 1 is protected with a metallic or metal-coated casing 7, shown in FIG. 1 apart from the printed board body for the sake of clarity. The casing 7 comprises a substantially planar rectangular upper plane 7*a* and side walls 7*b* and end walls 7*c* bent downward from the plane. The lower edge of each side wall 7*b* comprises three substantially uniformly spaced, downwardly extending projections 7*d*, and each end wall comprises one projection 7*d* positioned in the middle of the lower edge of the end wall. The casing is attached to the surrounding device incorporating the stripline circuit by means of the projections. Openings 7' are provided in the corners of the casing for receiving the corners of the printed board when the casing is fitted on the printed board.

Figure 2:
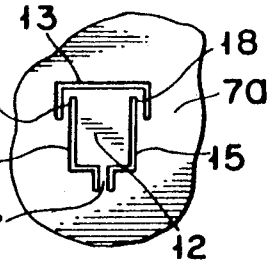
FIG. 2 is a top view of an area defined by one cover pattern shown in FIG. 1.

Five cover patterns are perforated in the upper plane 7*a* of the casing so that each cover 8 to 12 is positioned above the corresponding stripline pattern 2 to 6. In this case, all the cover patterns are similar. FIG. 2 shows in more detail the realization of each cover, that is, a top view of an area defined by the cover pattern forming the cover 12. The cover pattern is formed in the upper plane of the casing by punching, for instance. The pattern consists of elongated narrow slits 13, 14 and 15 in such a manner that the area remaining therebetween, that is, the cover 12, adjoins the casing portion surrounding the cover pattern only through triangularly disposed narrow strips 16, 17 and 18. Being supported at three points, the covers can be pressed downwards evenly over their entire area.

Figure 3:
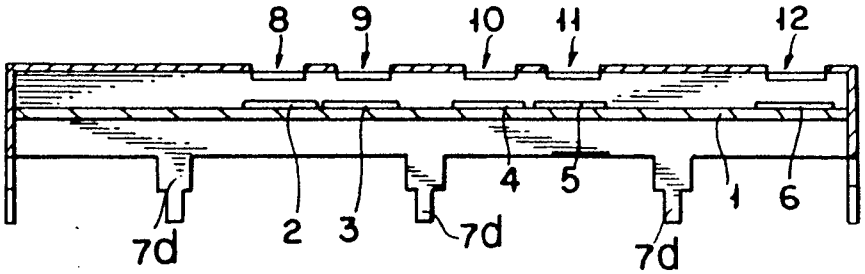
FIG. 3 is a cross-sectional view through the casing in the direction of the line I—I in FIG. 1 with the casing fitted on the printed board.

FIG. 3 shows a cross-section of the circuit structure with the casing 7 fitted in place on the printed circuit board 1, each cover 8 to 12 being disposed directly on the corresponding stripline pattern 2 to 6. The adjustment of the characteristic impedance of the stripline is carried out by pushing each cover to a desired distance from the corresponding stripline pattern. The adjustment itself appears from the above-mentioned Finnish Published Specification 78580. It is further to be mentioned that the different parts and distances are not drawn to scale. In FIG. 3, for instance, the striplines are shown only schematically for facilitating the understanding of the drawing.

Figure 4:
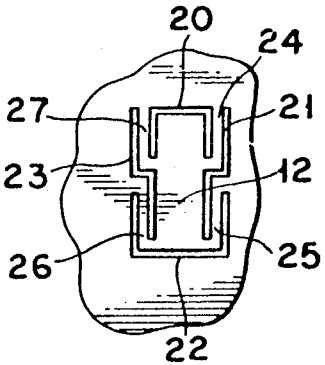
FIG. 4 shows an alternative embodiment for the cover pattern shown in FIG. 2.
Figure 5:
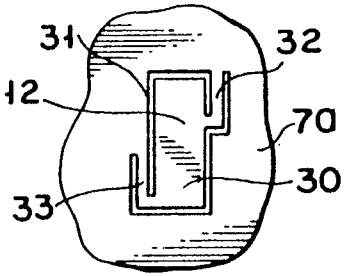
FIG. 5 shows another alternative embodiment for the cover patterns shown in FIGS. 2 and 4.

The cover need not be supported as shown in the embodiment of FIG. 2, but the shape of the cover pattern may be varied. Essential, however, is that the whole cover can be moved evenly. FIGS. 4 and 5 show only two other alternative ways of supporting the cover. In FIG. 4, where the cover is supported at four points, the cover pattern is formed by four separate elongated slits 20 to 23 which are shaped and fitted with respect to each other in such a manner that the cover 12 adjoins that portion of the casing which is surrounding the cover pattern through four narrow strips 24 to 27 positioned substantially squarely. In FIG. 5, where the cover is supported at two points, the cover pattern is formed by two separate elongated slits 30 and 31 which are shaped and fitted so with respect to each other that the cover 12 adjoins that portion of the casing which surrounds the cover pattern through two narrow strips 32 and 33 positioned at opposite corners of the cover.

Even though the invention has been described above with reference to the example of the attached drawing, it is to be understood that the invention is not restricted to it, but it can be modified in various ways within the normal technical knowledge of one skilled in the art. The covers, for instance, can be separate parts attached in an electrically conducting manner, such as spot welding or soldering, to the edges of an opening provided in the casing. This way of manufacture, however, is considerably more difficult and expensive than the above-described embodiment, in which the casing is perforated.

I claim:

1. A stripline circuit comprising at least two stripline patterns (2 to 6) made of a material of high electrical conductivity on the surface of a printed board (1) made of a dielectric material, a metallic or metal-coated cover (8 to 12) being provided above each stripline pattern in an electrically non-conducting manner with respect to it, and the distance of the cover (8 to 12) from the associated stripline pattern being adjustable to regulate the characteristic impedance of the stripline, characterized in that each cover (8 to 12) is integral with a casing (7) protecting the whole printed board (1).

2. A stripline pattern according to claim 1, characterized in that each cover (8 to 12) is formed by an area defined by a cover pattern (13 to 15; 20 to 23; 31, 32) perforated in the casing (7).

3. A stripline circuit according to claim 2 characterized in that portions of each cover are separated from said casing by said perforated cover pattern, and each cover is secured to said casing by spaced apart cover support points.

4. A stripline circuit according to claim 3 characterized in that said cover support points are positioned substantially triangularly with respect to one another.

5. A stripline circuit according to claim 3 characterized in that said cover support points are positioned substantially quadrilaterally with respect to one another.

6. A stripline pattern according to claim 3 characterized in that there are two cover support points (32, 33).

7. A stripline circuit comprising at least one stripline pattern (2) made of a material of high electrical conductivity on the surface of a printed board (1) made of a dielectric material, a metallic or metal-coated cover (8) being provided above said stripline pattern in an electrically non-conducting manner with respect to it, and the distance of the cover from said stripline pattern being adjustable to regulate the characteristic impedance of the stripline, characterized in that said cover is integral with a casing (7) protecting the whole printed board (1).

8. A stripline circuit according to claim 7, wherein said casing completely encloses said printed board.

* * * * *